US007383753B1

(12) United States Patent
Hajianpour

(10) Patent No.: US 7,383,753 B1
(45) Date of Patent: Jun. 10, 2008

(54) APPARATUS AND METHOD FOR OPENING A CONTAINER INCLUDING A DRIVE COUPLING DISENGAGED BY CONTACT WITH THE CONTAINER LID

(75) Inventor: Mohammed Ali Hajianpour, Fort Lauderdale, FL (US)

(73) Assignee: Zoya, Inc., Sunrise, FL (US)

( * ) Notice: Subject to any disclaimer, the term of this patent is extended or adjusted under 35 U.S.C. 154(b) by 1 day.

(21) Appl. No.: 11/491,843

(22) Filed: Jul. 24, 2006

(51) Int. Cl.
*B67B 7/00* (2006.01)

(52) U.S. Cl. ..... 81/3.2; 81/3.39

(58) Field of Classification Search ..... 81/3.2, 81/3.25, 3.31–3.33, 3.37, 3.42, 3.39
See application file for complete search history.

(56) References Cited

U.S. PATENT DOCUMENTS 2,026,118 A * 12/1935 Barnby ..... 81/3.2
4,171,650 A * 10/1979 Cardinal ..... 81/3.2
4,762,029 A * 8/1988 Chen ..... 81/3.2
5,271,296 A 12/1993 Parent et al.
5,353,665 A * 10/1994 Heebner ..... 81/3.2
5,647,251 A * 7/1997 Hardman ..... 81/3.2
6,293,170 B1 9/2001 Hajianpour
7,024,965 B2 4/2006 Tremblay

* cited by examiner

*Primary Examiner*—Hadi Shakeri
(74) *Attorney, Agent, or Firm*—Ronald V. Davidge

(57) ABSTRACT

A device for opening a container having a screw-on lid includes a rotating turntable for holding the container and a non-rotating lid engaging member that, after being driven in a first direction into the lid by an axial drive, is disengaged from the axial drive by deflection occurring within a coupling between the axial drive and the lid engaging member.

20 Claims, 6 Drawing Sheets

APPARATUS AND METHOD FOR OPENING A CONTAINER INCLUDING A DRIVE COUPLING DISENGAGED BY CONTACT WITH THE CONTAINER LID

BACKGROUND OF THE INVENTION

1. Field of the Invention

This invention relates to a container opener having a rotationally driven turntable for imparting relative rotation between the container and the lid and, more particularly, to such a container opener additionally having an axial drive moving a lid engaging structure into contact with the lid.

2. Summary of the Background Art

The patent literature includes a number of descriptions of jar openers including rotationally driven turntables/. For example U.S. Pat. Nos. 6,293,170 and 7,024,963 describe jar openers in which a lid engaging, non-rotating structure is manually moved and held down against the lid of a jar resting on a rotationally driven turntable. In the apparatus of U.S. Pat. No. 6,293,170, the action of depressing the lid closes an electrical circuit to turn on a motor driving the turntable, while releasing the lid breaks this circuit to turn the motor off. In the apparatus of U.S. Pat. No. 7,024,965, manually rotating a wheel at each end of a shaft extending across the top of the lid engaging structure moves the structure downward against the jar lid by means of a pair of gears attached to the shaft and engaging racks formed within the vertical guide shafts on which the lid engaging structure slides.

Other jar opening devices include an axial drive, moving the non-rotating lid engaging structure downward against the lid. In such devices, a mechanism must be provided for disengaging the axial drive after the lid has been engaged, or, at least after the lid is unscrewed. For example, U.S. Pat. No. 5,271,296 in which the axial drive brings the lid engaging structure into engagement with the lid and then slips to permit the cap to be removed from the container, with the slippage occurring in a slip clutch through which lead screws are driven to form the axial drive. Then, a control unit sensing a torque created by the relative rotation between the lid and the lid engaging structure cause the rotational drive, which rotates both the lead screws and the turntable turning the jar, to reverse its direction of movement, moving the lid engaging structure and the lid away from the jar.

A potential problem associated with using variations in the level of torque required to cause relative rotation between the lid and the jar arises from the fact that substantial variations in the torque levels required must be expected to occur between a jar having a small lid that has been unscrewed many times before and a jar having a large lid that has never been unscrewed before. Thus, what is needed is an automatic mechanism for disengaging the axial drive without relying on measurements of the torque required to cause relative rotation between the lid and the jar.

SUMMARY OF THE INVENTION

In accordance with one aspect of the invention, a container opener is provided for opening a container having a screw-on lid, with the container opener including a turntable having a container supporting surface, a rotational drive causing rotation of the turntable, a lid engaging member, an axial drive moving the lid engaging member in a first direction, toward the turntable, and opposite this first direction, and a coupling. The container engaging surface engages a surface of the container opposite the lid of the container. The lid engaging member is slidably mounted to move in the first direction and opposite the first direction. The coupling, which includes a drive portion engaging the axial drive and a resilient portion disposed between the drive portion and the lid engaging member, holds the axial drive in engagement with the lid engaging member as the axial drive moves the lid engaging member toward the lid of a container on the container supporting surface. Then, as the lid engaging member is held in engagement with the lid of the container, deflection of the resilient portion in the first direction disengages the axial drive from the lid engaging member.

The term "container" is used herein to indicate a number of vessels that would ordinarily be called either "jars" or "bottles," since there is no need to distinguish between such vessels. Similarly, while a "screw-on lid" is described herein, this is not meant to differentiate from a "twist-off top."

Preferably, the axial drive includes a pair of leadscrews and a motor drive rotating each of the leadscrews in a first rotational direction and opposite the first rotational direction. The drive portion of the coupling preferably includes a drive nut engaging each of the leadscrews to be driven in the first direction as the leadscrew is rotated in the first rotational direction and opposite the first direction as the leadscrew is rotated opposite the first rotational direction. The lid engaging member then includes a coupling surface releasably engaging each drive nut. The resilient portion of the coupling comprises a string holding each drive nut in engagement with the coupling surface of the lid engaging member. Each drive nut is pulled out of engagement with the adjacent coupling surface by axial movement of the drive nut with the lid engagement member is held in engagement with the lid of the container.

The leadscrews are rotationally driven in the first rotational direction until the drive nuts are pulled out of engagement with the adjacent coupling surface. Then, the leadscrews are driven opposite the first rotational direction. Since the leadscrew no longer pulls the drive nuts in the first direction, the springs return the drive nuts into engagement with the coupling surfaces, and the lid engaging member is driven opposite the first direction. In a first embodiment of the invention, the leadscrews are driven in the first direction while a first button is depressed and held down and opposite the first direction while a second button is depressed and held down. In a second embodiment of the invention, the leadscrews are driven in the first direction following a momentary depression of a button until a first switch is actuated by contact between the lid engaging member and the lid of the container. Then, the leadscrews are driven opposite the first direction until a second switch is actuated by movement of the lid engaging member to a limit of its movement opposite the first direction.

According to another aspect of the invention, a method for loosening a screw-on lid of a container is provided, with the method including:

a) placing an end of the container opposite the lid on a turntable;

b) rotating the turntable while bringing a non-rotating lid engaging member into contact with the lid in a first direction toward the turntable by an axial drive resiliently coupled to the lid engaging member; and c) disengaging the axial drive mechanism from the lid engaging member in response to sensing deflection in the first direction within a resilient portion of a coupling between the axial drive and the lid engaging member with the lid engaging member in engagement with the lid.

DETAILED DESCRIPTION OF THE INVENTION

Figure 1:
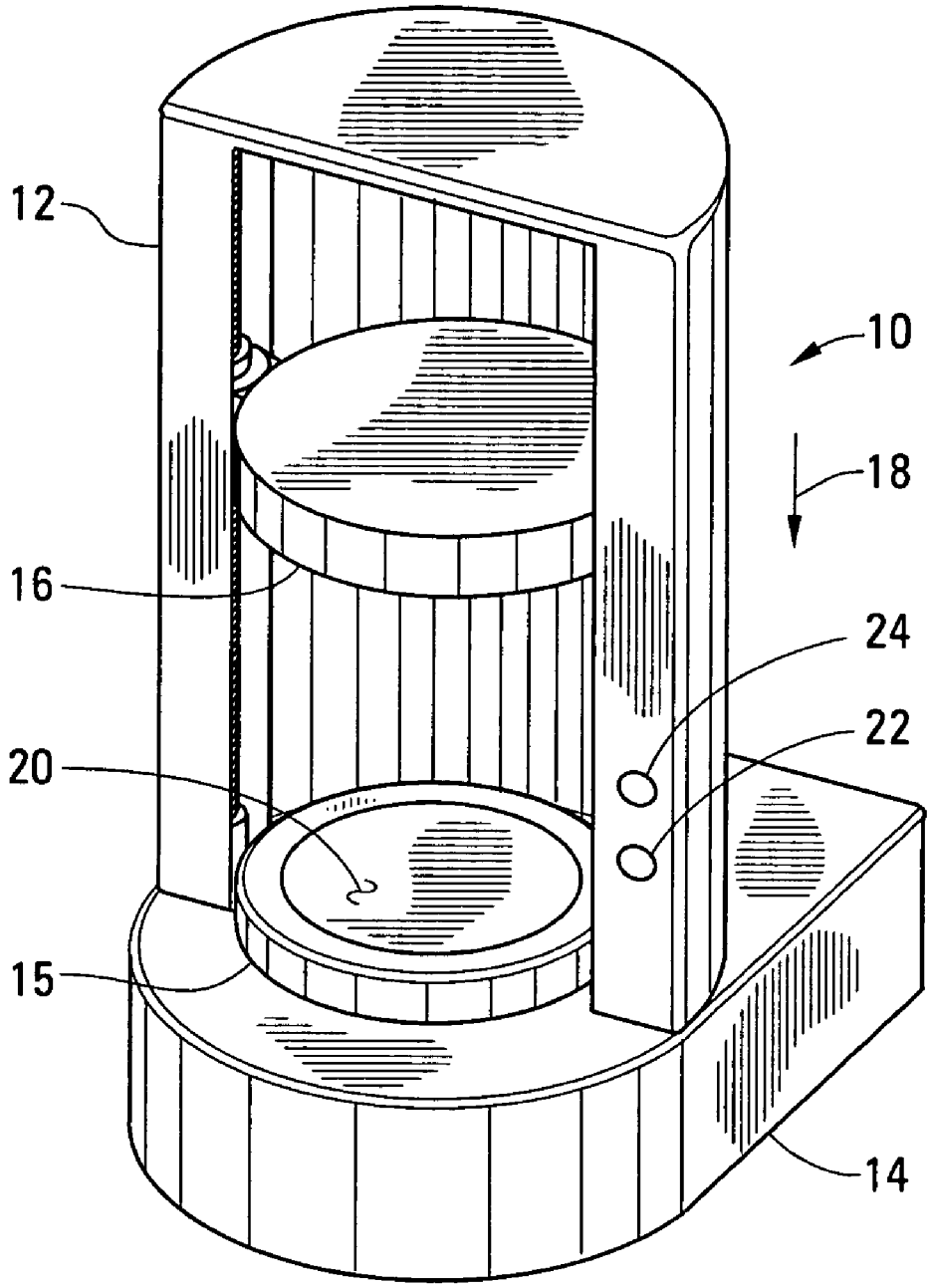
FIG. 1 is a perspective view of a container opener built in accordance with a first embodiment of the invention.

FIG. 1 is a perspective view of a container opener 10 built in accordance with a first embodiment of the invention to include an upper housing 12, a lower housing 14, a turntable 15, rotatably mounted atop the lower housing 14, and a lid engaging member 16, slidably mounted within the upper housing 12 to move in a first direction, indicated by arrow 18, and opposite this first direction. The turntable 16 includes a container supporting surface 20, for engaging a surface of a container placed within the container opener 10. The container opener 10 also includes a first pushbutton 22 that is depressed and held to move the lid engaging member 16 in the first direction of arrow 18, into engagement with the lid of a container placed on the container supporting surface 20, an a second pushbutton 24 that is depressed and held to move the lid engaging member 16 opposite the first direction of arrow 10.

Figure 2:
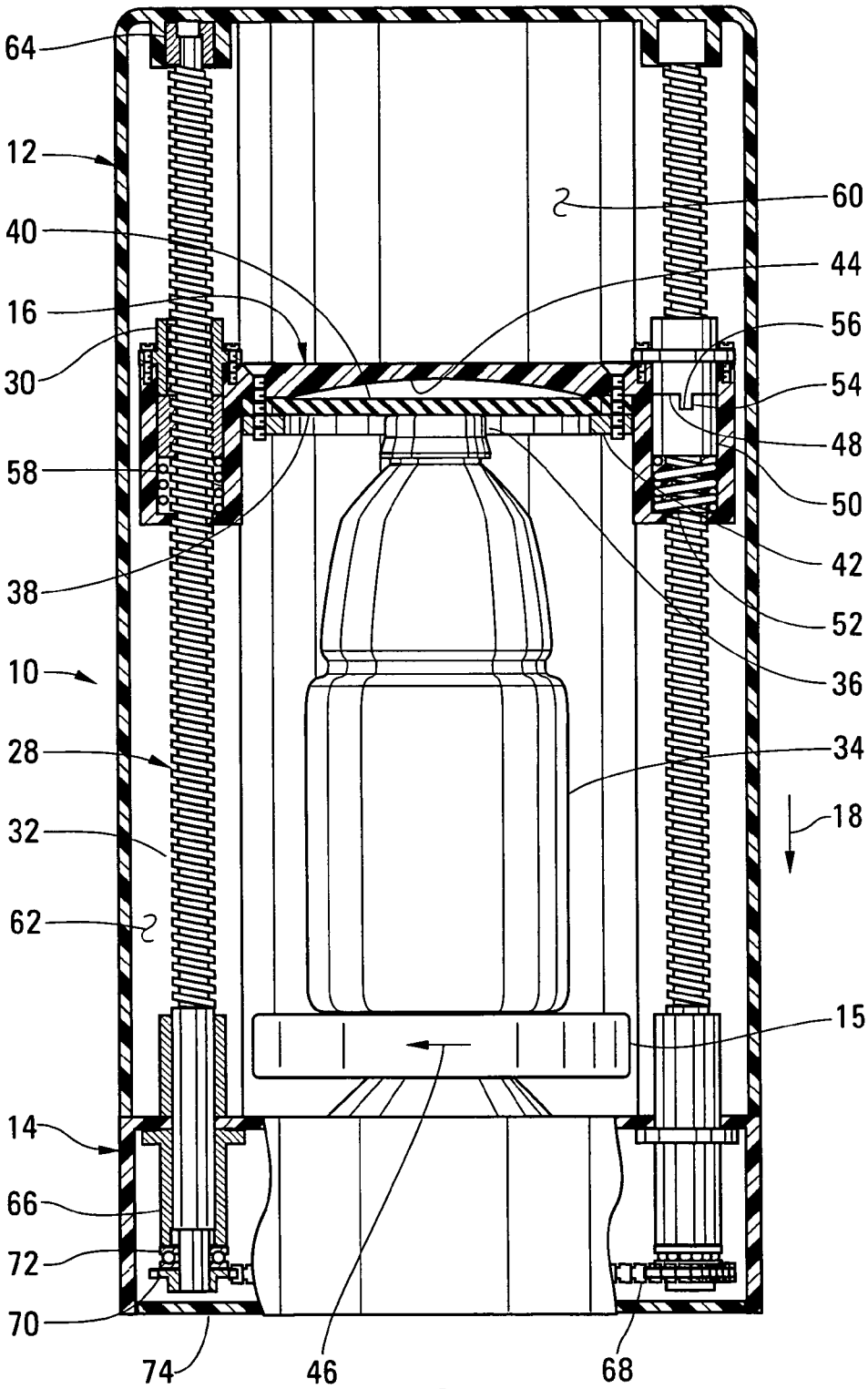
FIG. 2 is a cross-sectional elevation of the container opener of FIG. 1.

FIG. 2 is a cross-sectional elevation of the container opener 10, showing elements of an axial drive 26, which is provided to move the lid engaging member 16 in the first direction, indicated by arrow 18, and opposite thereto. The axial drive 26 includes a pair of leadscrews 28, which are additionally used to slidably mount the lid engaging member 16 within the upper housing 12. To this end, the lid engaging member 16 includes a pair of bushings 30, which slide along the outer surfaces 32 of the leadscrews 28, as the leadscrews 28 are rotated in a first rotational direction to move the lid engaging member 16 in the first direction of arrow 18 and opposite the first rotational direction to move the lid engaging member 16 opposite the first direction of arrow 18.

(While the two leadscrews 28 and associated elements are identical, the associated elements are shown in cross-section on one of the leadscrews 28 and in a full view on the other leadscrew 28, so that internal and external features of the associated elements can be visualized.)

In the example of FIG. 2, a container 34 having a screw-on lid 36 is placed atop the turntable 15, with the lid engaging member 16 being shown as having been moved, in the first direction of arrow 18, into initial engagement with the lid 36. In particular, a lower surface 38 of a flexible sheet 40 within the lid engaging member 16 has been brought into contact with the lid 36. The flexible sheet 40 is clamped by a ring 42 to extend below a concave support surface 44 within the lid engaging member 16. Continuing downward movement of the lid engaging member 16, in the direction of arrow 18, deflects the flexible sheet 40 upward, with the flexible sheet 40 being held in intimate contact with the lid 36, and with the rotational movement of the container 34 in the direction of arrow 46 with the turntable 15 causing the lid 36 to unscrew from the container 34. Preferably, both the flexible sheet 40 and the container supporting surface 20 (shown in FIG. 1) of the turntable 15 are formed of a flexible material having an extremely tacky external surface, with good results having been obtained using a DYCEM® non slip pad supplied by Dycem of Warwick, R.I., USA.

Each of the bushings 30 within the lid engaging member 16 includes a coupling surface 48, against which an adjacent drive nut 50 is held by a compression spring 52, with rotation of the drive nut 50 being prevented, for example, by four ridges 54 of the bushing 30, equally spaced around the bushing, extending into grooves 56 within the drive nut 50. As long as the drive nut 50 is held in contact with the non-rotating bushing 30, rotation of the drive nut is prevented. However, when continued downward movement of the lid engaging member 16, in the direction of arrow 18, is prevented by contact with the container lid 36, continued downward movement of the drive nuts 50 results in the compression of springs 52, with the drive nuts 50 being pulled out of engagement with the coupling surfaces 48 of the bushings 30. When this occurs, the drive nuts 50 begin to rotate within cylinders 58 of the lid engaging member 16, matching the rotation of the leadscrews 28. In this way, each drive nut 50 is pulled out of engagement with the adjacent coupling surface 48 by axial movement of the drive nut 50 with the lid engaging member 16 held in engagement with the container lid 36, and with further downward movement of the lid engaging member 16 being prevented.

Before the drive nuts 50 are pulled out of engagement with the coupling surface 48, the rotation of the turntable 15 in the direction of arrow 46 with rotation the lid 36 being prevented by contact with the lid engaging member 16, causes the lid 36 to unscrew from the container 34 on the turntable 14. After the drive nuts 50 are pulled out of engagement with the coupling surfaces 48, the springs 52 remain compressed, pushing the lid engaging member 16 downward to exert a downward force on the container lid 36. The user then releases the first button 22, stopping the downward movement of the lid engaging member 16, and depresses the second button 24 to move the lid engaging member 16 upward. When the user releases the second button 24, the movement of the lid engaging member 16 stops.

The upper housing 12 includes a concave rear wall 60, which extends outward to form a channel 62 at each side, in which a leadscrew 28 extends. Each of the leadscrews 28 is rotatably mounted within an upper bearing 64 in the upper housing 12 and within an lower bearing 66 in the lower housing 14. Each of the leadscrews 28 is rotatably driven by a drive chain 68 from a motor drive within the lower housing 14, engaging a sprocket 70 attached to the leadscrew 28. As the lid 36 is being unscrewed from the container 34, a substantial downward force, in the direction of arrow 18, is applied to the lid 36, with a corresponding substantial upward force being applied to the leadscrews 28 through a pair of thrust bearings 72.

Figure 3:
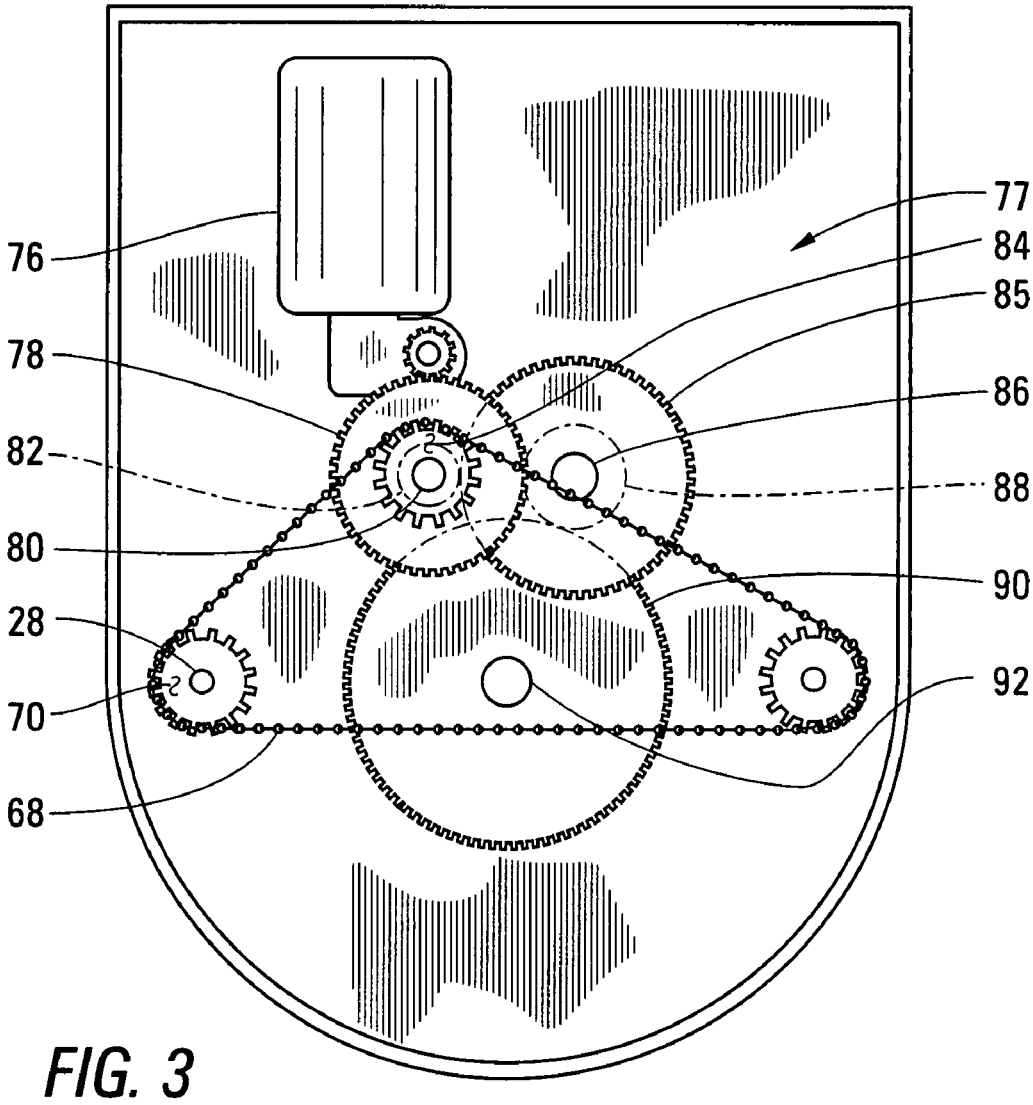
FIG. 3 is a bottom plan view of the container opener of FIG. 1, shown with a bottom cover removed.

FIG. 3 is a bottom plan view of the container opener 10, taken with a bottom cover 74 (shown in FIG. 2) removed to show various components driving the leadscrews 28 and the turntable 46. Referring to FIGS. 2 and 3, a permanent magnet, direct current gear-motor 76 drives a gear train 77 to rotate the turntable 15 and the chain 68 to rotate the leadscrews 28. Specifically, the motor 76 drives a first idler gear 78, attached to rotate with a first rotatably mounted idler shaft 80, with a second idler gear 82, and with a drive sprocket 84. The drive sprocket 84 engages the drive chain 68 to drive the sprockets 70 attached to the leadscrews 28, while the second idler gear 82 drives a third idler gear 85. The third idler gear 85 is attached to rotate with a second rotatably mounted idler shaft 86 and with a fourth idler gear 88. The fourth idler gear 88 drives a driven gear 90, which drives the turntable 15 in rotation through a driven shaft 92. To unscrew a typical container lid 36 attached with a right-hand thread, the turntable 15 must turn in the direction indicated by arrow 46 while the leadscrews 28 pull the lid engaging member 16 downward, in the direction of arrow 18. Since the gear train 77 is arranged so that the sprockets 70, attached to the leadscrews 28, and the driven gear 90, turning with the turntable 15, rotate in the same direction, the leadscrews 28 are provided with left-hand threads.

The use of a single motor 76 to drive both the turntable 15 and the leadscrews 28 causes the turntable to reverse its direction of travel when the leadscrews 28 are reversed to drive the lid engaging member 30 upward, opposite the direction of arrow 18. Since, this occurs after the container lid 36 has been loosened, it is not retightened. Alternately, a clutch may be provided to disengage the turntable 15 from rotating opposite the direction of arrow 46, or a separate motor may be provided to drive the turntable 15 only in the direction of arrow 46.

Figure 4:
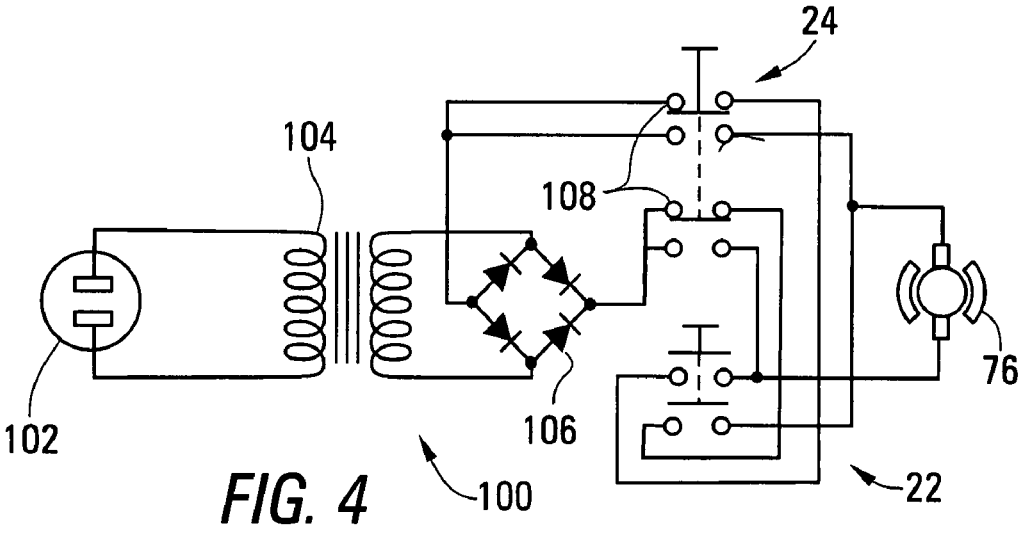
FIG. 4 is a schematic view of a drive circuit within the container opener of FIG. 1.

FIG. 4 is a schematic view of a drive circuit 100 within the container opener 10. The drive circuit 100 includes a plug 102 for attachment to an external, alternating-current, line current source, a transformer 104 for reducing the voltage available from the plug 102, and a rectifier 106 for producing direct current to run the permanent magnet motor 76. When the first pushbutton 22 is depressed, electrical current is directed through the motor 76 in a direction causing the leadscrews 28 to move the lid engaging member 16 downward, in the direction of arrow 18, and to cause the turntable 15 to rotate in the direction of arrow 46. When the second pushbutton 24 is depressed, electrical current is directed through the motor 76 in a direction causing the leadscrews 28 to move the lid engaging member 16 upward, opposite the direction of arrow 18. When neither of the pushbuttons 22, 24 is depressed, electrical current is not driven through the motor 76, providing the user with an easy way to stop the motion of the lid engaging member 16 if necessary to prevent injury or damage. In the example of FIG. 4, the first pushbutton 22 is wired through normally-closed contacts 108 of the second pushbutton 24, so that a short circuit is not caused by simultaneously depressing the pushbuttons 22, 24. Thus, the container opener 10 operates in a first state, with the first pushbutton 22 depressed and with the motor 76 driving the lid engaging member 16 downward, in the direction of arrow 18, in a second state, with the pushbutton 24 depressed and with the motor 76 driving the lid engaging member 15 upward, in the direction of arrow 18, and in a third state, with neither of the pushbuttons 22, 24 being depressed and with the lid engaging member 15 being held stationary.

Figure 5:
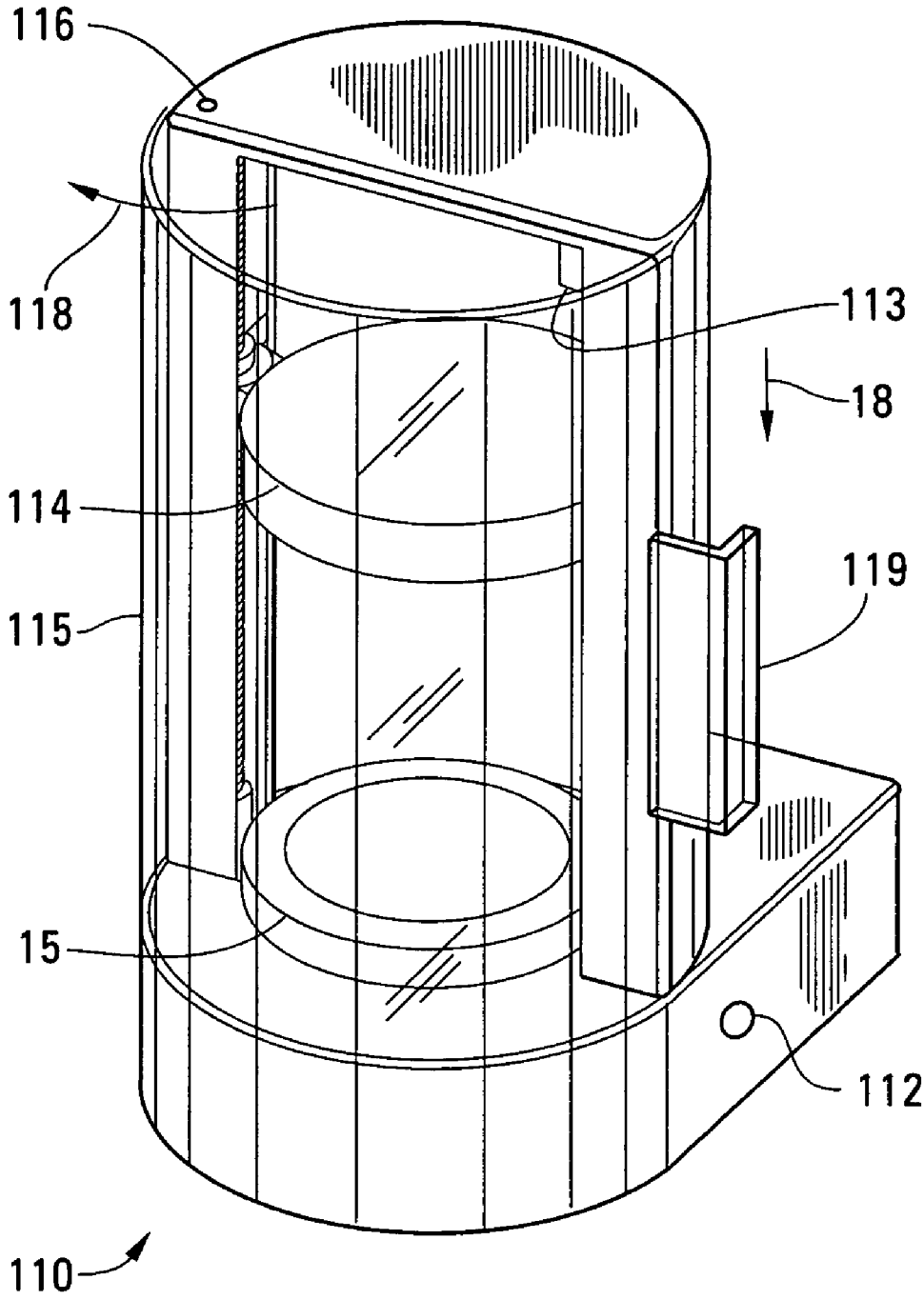
FIG. 5 is a perspective view of a container opener built in accordance with a second embodiment of the invention.

FIG. 5 is a perspective view of a container opener 110 built in accordance with a second embodiment of the invention to perform the complete jar opening process in response to a momentary depression of a single pushbutton 112. The container opener 110 has many elements that are essentially identical to corresponding elements within the container opener 10, which has been discussed above in reference to FIG. 1, with such essentially like elements therefore being accorded like reference numerals.

The container opener 110 additionally includes a limit switch 113 that is actuated as the lid engaging member 114 nears the upper end of its movement, opposite the direction of arrow 18, being returned upward after loosening the lid of a container. Since the processes occurring within the container opener 110 is allowed to run to completion following depression of the single pushbutton 112, the user is no longer provided with a simple way for stopping the process by releasing a pushbutton, as in the case of the container opener 10. Therefore, the container opener 110 is additionally provided with an interlocked safety cover 115, which is pivoted at pins 116 to be swung open in the direction of arrow 118. The cover 115, which includes a handle 119 to facilitate opening and closing, is composed, for example, of a transparent thermoplastic resin.

A method for interlocking the cover 115, to prevent operation of the container opener 110 without the cover 115 closed, will now be discussed, with reference being made to FIG. 6, a cross-sectional plan view of the container opener 110, and to FIG. 7, a fragmentary cross-sectional elevation thereof, taken as indicated by section lines 7-7 in FIG. 6. As the cover 115 is pivoted shut about its pivot pins 116, opposite the direction of arrow 118, an actuator 120 of an interlock switch 122 attached to the upper housing 124 is engaged by a tab 126 extending inward as a portion of the cover 115, moving the actuator 120 to close normally-open contacts within the switch 122. This action closes a circuit to allow operation of the container opener 110, in a manner to be described in reference to FIG. 9. Preferably, the tab 126 additionally includes a depression 128, which provides a detent action to hold the cover 115 shut.

Figure 6:
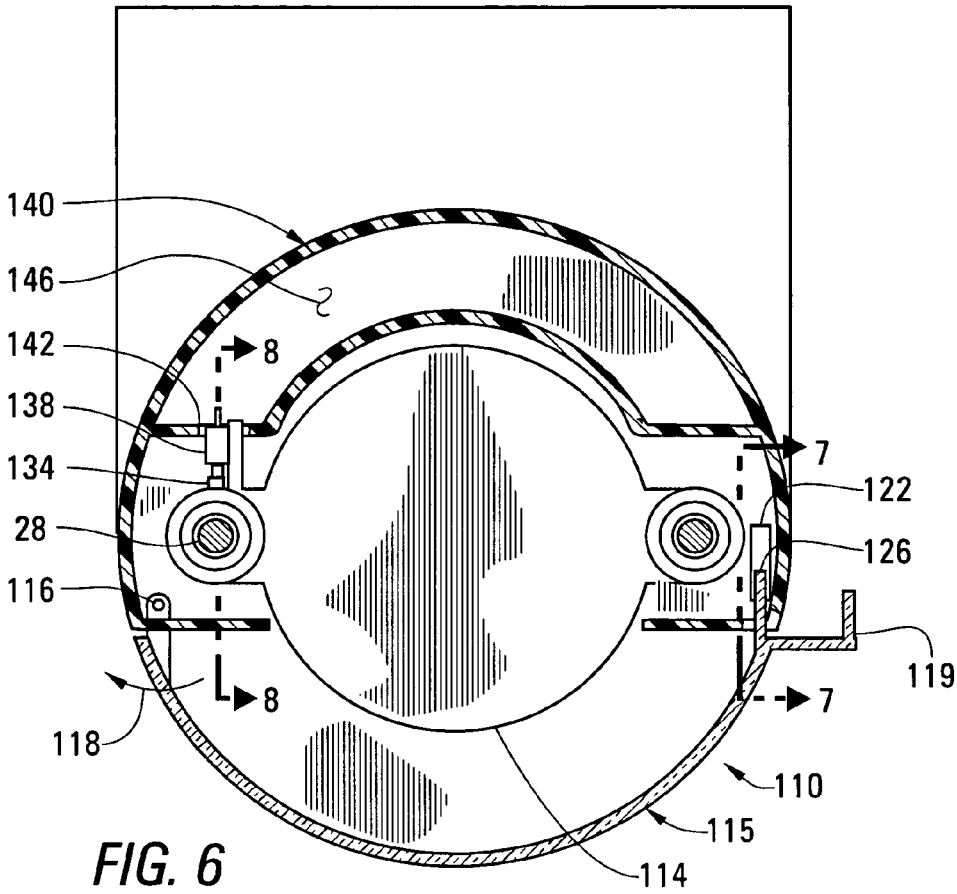
FIG. 6 is a cross-sectional plan view of the container opener of FIG. 5.
Figure 7:
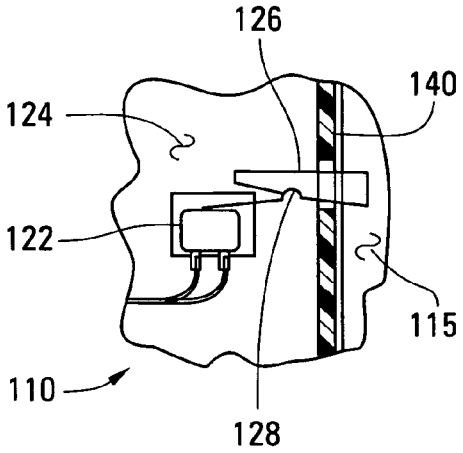
FIG. 7 is a fragmentary cross-sectional elevation of the container opener of FIG. 5; taken as indicated by section lines 7-7 in FIG. 6.
Figure 8:
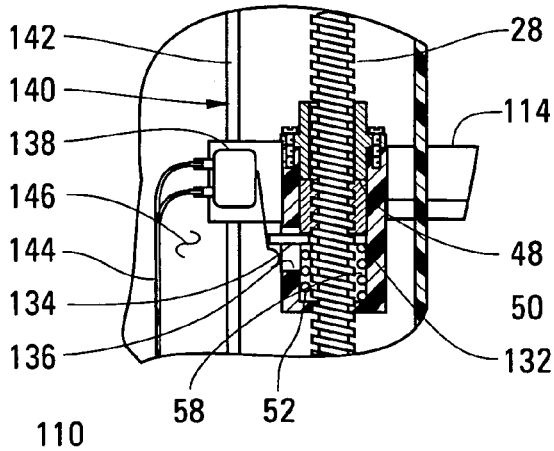
FIG. 8 is a fragmentary cross-sectional elevation of the container opener of FIG. 5; taken as indicated by section lines 7-7 in FIG. 6.

FIG. 8 is a fragmentary cross-sectional elevation of the container opener 110, taken as indicated by section lines 8-8 in FIG. 6. Referring to FIGS. 6 and 8, the container opener 110 includes a pair of drive nuts 50, operating as previously described in reference to FIG. 2 to drive a lid engaging member 114 downward, in the direction of arrow 18, with each of the drive nuts 50 being held in contact with an adjacent coupling surface 48 by a compression spring 52, and with the drive nuts 40 being pulled away from the coupling surfaces 48 by continuing rotation of the leadscrews 28 with the lid engaging member 114 in contact with the lid 36 of a container 38. In the container opener 110, a washer 132 is additionally placed between one of the drive nuts 50 and the compression spring 52, with a tab 134 of the washer 132 extending outward through a slot 136 in the lid engaging member 114. The washer 132 moves with the drive nut 50, so that the motion of the drive nut 50 within the cylinder 58 in which it is held actuates a mode switch 138 attached to the lid engaging member 114. The mode switch 138 extends through a slot 142 in the upper housing 140 of the container opener 110, with wires 144 from the mode switch 138 extending within a cavity 146 in the housing 140, to move with motion of the lid engaging member 114.

Figure 9:
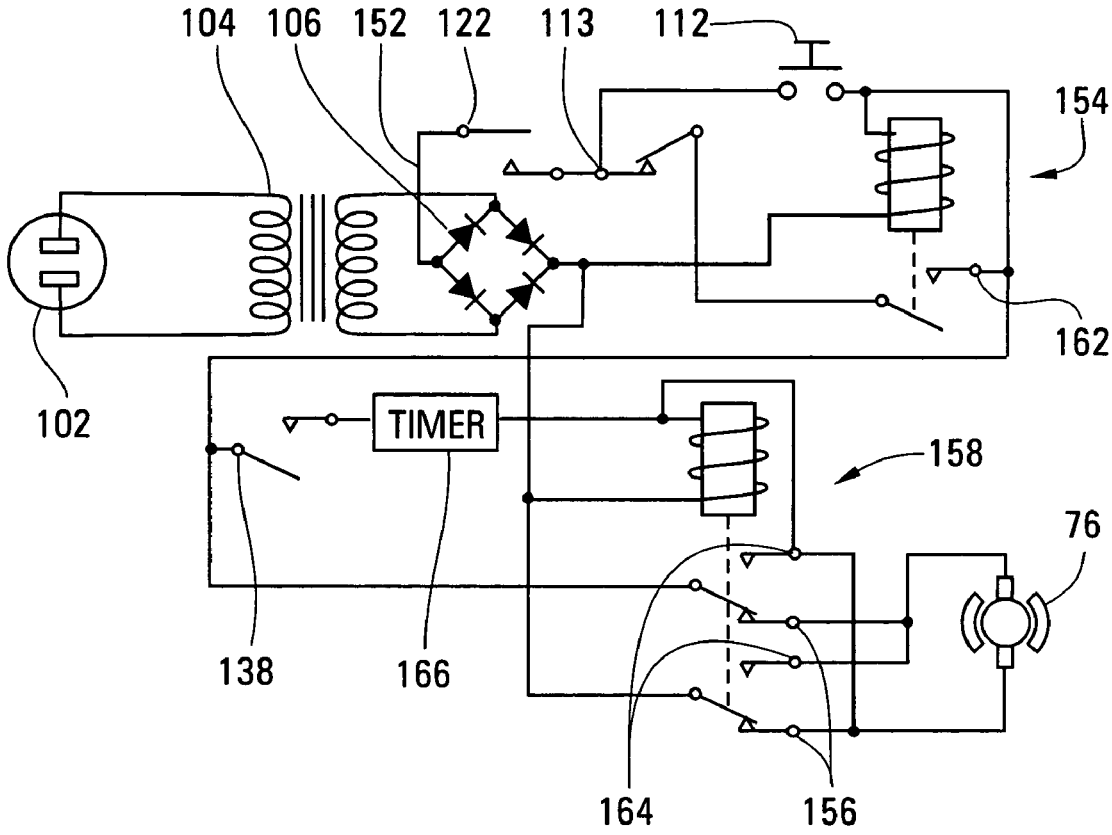
FIG. 9 is a schematic view of a drive circuit within the container opener of FIG. 5.

FIG. 9 is a schematic view of a drive circuit 150 within the container opener 110. The drive circuit 150 includes elements similar to the elements of the drive circuit 100, which have been described above in reference to FIG. 4, and which are therefore accorded like reference numerals. Such elements comprise a plug 102 for attachment to an external, alternating-current, line current source, a transformer 104 for reducing the voltage available from the plug 102, and a rectifier 106 for producing direct current to run the permanent magnet motor 76.

An output line 152 from the rectifier 106 is connected to a remaining portion of the drive circuit 150 through the interlock mode switch 138, so that the lid engaging member 114 will not be moved with the safety cover 115 open. When the safety cover 115 is open, external access to the area between the lid engaging member 114 and the turntable 15 is provided, so that a container 34 can be placed on the turntable 15 or removed therefrom. When the safety cover 115 is closed such access is prevented by the cover 115. Thus, when the pushbutton 112 is depressed with the cover 115 closed to hold the interlock mode switch 138 closed, a first relay 154 is actuated, and the motor 76 is turned on through normally closed contacts 156 within a second relay 158 to move the lid engaging member 114 downward, in the direction of arrow 18. A holding circuit for the first relay 154 includes a limit switch 113 that is opened when the lid engaging member 114 moves to the end of its upward motion, opposite the direction of arrow 18, and that is closed as the lid engaging member 114 moves downward, away from the end of its upward motion. Therefore, to start the process of opening a container, the pushbutton 112 is held down long enough for the lid engaging member 114 to be driven away from the end of its upward motion by the motor 76, with the first relay 154 then being held closed through the switch 160 and through the relay contact 162.

When the lid engaging member 114 is brought into contact with a container lid 36, a mode switch 138 is closed, as explained in detail above in reference to FIG. 8, beginning a process of switching the direction of the motor 76, so that the lid engaging member 114 will be driven upward, opposite the direction of arrow 18, after the container lid 26 is loosened. This is done by closing the second relay 158, so that the motor 76 is driven through the normally open contacts 164 of this relay 158, which are arranged to drive the motor 76 in a direction causing the lid engaging member 114 to be driven upward. In the example of FIG. 9, a timer 166, actuated by the closure of the mode switch 138, is included to delay the actuation of the relay 158, in order to assure that the downward movement of the drive nuts 50 within the cylinders 58 of the lid engaging member 114 has been completed before the direction of the motor 76 is reversed. Such a timer can be constructed using a device, such as a electronic or electromechanical timer that is well known to a person skilled in the art of electronic design, or a well method, such as counting revolutions of the motor 76 following the actuation of the mode switch 138. Alternatively, the inertia of the motor 76 and drive components may be relied upon to provide a sufficient time delay. After the relay 158 is actuated, the lid engaging member 114 is driven upward, opposite the direction of arrow 18, until near the top of it's movement, the lid engaging member 114 contacts the limit mode switch 138, opening its contact, so that electrical current is dropped to the first relay 154, the second relay 158, and the motor 76, stopping movement of the lid engaging member 114.

Thus, upon depression of the pushbutton 112, container opener 110 enters a first state of operation, in which the lid engaging member 114 is driven downward, with the first relay 154 closed. Then, in response to closing the mode switch 138, a second state of operation is entered, with the second relay 158 closed, and with the lid engaging member 114 being driven upward. Finally, in response opening the contacts of a limit switch 122, as the lid engaging member 114 reaches the upper limit of its motion, a third state of operation is entered, with the relays 154, 158 opening, and with the motor 75 stopping to stop movement of the lid engaging member 114.

While the invention has been described in its preferred embodiments with some degree of particularity, it is understood that this description has been given only by way of example and that many variations in the arrangement of elements within a device can be achieved without departing from the spirit and scope of the invention, as described in the attached claims.

What is claimed is:

1. A container opener for a container having a screw-on lid, comprising:

a turntable having a container supporting surface for engaging a surface of the container opposite a lid thereof;

a rotational drive causing rotation of the turntable;

a lid engaging member slidably mounted to move in a first direction toward the turntable, and opposite the first direction;

an axial drive moving the lid engaging member in the first direction and opposite the first direction; and a coupling holding the axial drive in engagement with the lid engaging member as the axial drive moves the lid engaging member toward the lid of a container on the container supporting surface, wherein the coupling includes a drive portion engaging axial drive and a resilient portion disposed between the drive portion and the lid engaging member, and wherein deflection within the resilient portion in the first direction disengages the axial drive from the lid engaging member.

2. The container opener of claim 1, wherein the axial drive comprises a pair of leadscrews and a motor drive rotating each of the leadscrews in a first rotational direction and opposite the first rotational direction, the drive portion of the coupling comprises a drive nut engaging each of the leadscrews to be driven in the first direction as the leadscrew is rotated in the first rotational direction and opposite the first direction as the leadscrew is rotated opposite the first rotational direction, the lid engaging member comprises a coupling surface releasably engaging each drive nut, the resilient portion of the coupling comprises a spring holding each drive nut in engagement with the coupling surface; and each drive nut is pulled out of engagement with an adjacent coupling surface by movement of the drive nut in the first direction with the lid engaging member held in engagement with the lid of a container.

3. The container opener of claim 2, wherein the motor drive is reversible to move the drive nut engaging each of the leadscrews opposite the first direction.

4. The container opener of claim 3, wherein the motor drive comprises:

a motor;

an electrical circuit attached to the motor, operating in a first state, with the electrical circuit arranged to drive the motor to move the drive nuts in the first direction, a second state, with the electrical circuit arranged to drive the motor to move the drive nuts opposite the first direction, and a third state, with the motor is turned off to leave the drive nuts stationary.

5. The container opener of claim 4, wherein the electrical circuit is held in the first state by depressing and holding a first pushbutton, in the second state by depressing and holding a pushbutton, and in the third state by releasing the first and second pushbuttons.

6. The container opener of claim 4, wherein the electrical circuit is moved into the first state by depressing a pushbutton, into the second state by actuating a mode switch by movement of the drive nut in the first direction with the lid engaging member engaging the lid of a container, and into the third state by movement of the lid engaging member opposite the first direction.

7. The container opened of claim 6, wherein the electrical circuit comprises:

a first relay, closed in response to depression of the pushbutton, wherein closing the first relay causes the motor to rotate;

a second relay closed in response to actuating the mode switch, wherein the motor moves the drive nuts in the first direction with the first relay closed and the second relay open, and wherein the motor moves the drive nuts opposite the first direction with the first and second relays closed; and a limit switch, actuated by moving the lid engaging member opposite the first direction near an end of its movement away from the turntable, wherein actuating the limit switch opens the first relay.

8. The container opener of claim 1, wherein each drive nut is prevented from rotation while engaged with the adjacent coupling surface, and each drive nut is free to rotate while disengaged from the adjacent coupling surface.

9. The container opener of claim 1, additionally comprising a safety cover movable between an open position, in which external access is provided into an area between the turntable and the lid engaging member, and a closed position, in which the safety cover blocks external access into the area between the turntable.

10. The container opener of claim 9, additionally comprising an electrical switch to prevent movement of the lid engaging member with the safety cover in the open position.

11. A method for loosening a screw-on lid of a container, wherein the method comprises:

a) placing an end of the container opposite the lid on a turntable;

b) rotating the turntable while bringing a non-rotating lid engaging member into contact with the lid in a first direction toward the turntable by an axial drive resiliently coupled to the lid engaging member through a coupling including a drive portion engaging the axial drive and a resilient portion disposed between a drive portion and the lid engaging member; and c) disengaging the axial drive mechanism from the lid engaging member in response to deflection in the first direction within the resilient portion of the coupling between the axial drive and the lid engaging member with the lid engaging member in engagement with the lid.

12. The method of claim 11, additionally comprising moving the lid engaging member opposite the first direction, away from the turntable.

13. The method of claim 11, additionally comprising, between steps a) and b), closing a safety cover movable between an open position, in which external access is provided into an area between the turntable and the lid engaging member, and a closed position, in which the safety cover blocks external access into the area between the turntable.

14. The method of claim 13, wherein closing the safety cover actuates an electrical switch, allowing movement of the lid engaging member with the safety cover in the open position.

15. A method for loosening a screw-on lid of a container, wherein the method comprises:

a) placing an end of the container opposite the lid on a turntable;

b) rotating the turntable while bringing a non-rotating lid engaging member into contact with the lid in a first direction toward the turntable by an axial drive resiliently coupled to the lid engaging member, wherein the axial drive comprises a pair of leadscrews and a motor drive rotating each of the leadscrews in a first rotational direction and opposite the first rotational direction, and wherein the lid engaging member includes a pair of coupling surfaces;

c) disengaging the axial drive mechanism from the lid engaging member in response to deflection in the first direction within a resilient portion of a coupling between the axial drive and the lid engaging member with the lid engaging member in engagement with the lid, wherein the coupling includes a drive nut engaging each of the each of the leadscrews, to be driven in the first direction as the leadscrew is rotated in the first rotational direction and opposite the first direction as the leadscrew is rotated opposite the first rotational direction, and the resilient portion, including a spring holding each drive nut in engagement with one of the coupling surfaces of the lid engaging member; and d) moving the lid engaging member opposite the first direction, away from the turntable.

16. The method of claim 15, wherein each drive nut is prevent from rotation while engaged with the coupling surface, and each drive nut it free to rotate while disengaged from the adjacent coupling surface.

17. The method of claim 15, wherein the motor drive comprises:

a motor;

an electrical circuit attached to the motor, operating in a first state, with the electrical circuit arranged to drive the motor to move the drive nuts in the first direction, a second state, with the electrical circuit arranged to drive the motor to move the drive nuts opposite the first direction, and a third state, with the motor is turned off to leave the drive nuts stationary.

18. The method of claim 17, wherein the electrical circuit is held in the first state by depressing and holding a first pushbutton, in the second state by depressing and holding a pushbutton, and in the third state by releasing the first and second pushbuttons.

19. The method of claim 17, wherein the electrical circuit is moved into the first state by depressing a pushbutton, into the second state by actuating a mode switch by movement of the drive nut in the first direction with the lid engaging member engaging the lid of a container, and into the third state by movement of the lid engaging member opposite the first direction.

20. The method of claim 17, wherein the electrical circuit comprises:

a first relay, closed in response to depression of the pushbutton, wherein closing the first relay causes the motor to rotate;

a second relay closed in response to actuating the mode switch, wherein the motor moves the drive nuts in the first direction with the first relay closed and the second relay open, and wherein the motor moves the drive nuts opposite the first direction with the first and second relays closed; and a limit switch, actuated by moving the lid engaging member opposite the first direction near an end of its movement away from the turntable, wherein actuating the limit switch opens the first relay.

* * * * *